United States Patent [19]

Popp et al.

[11] Patent Number: 4,572,959

[45] Date of Patent: Feb. 25, 1986

[54] CONTAINER FOR THE INTERIM AND LONG-TERM STORAGE OF RADIOACTIVE MATERIAL

[75] Inventors: Franz-Wolfgang Popp, Wedemark; Kurt Feuring, Solms, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 451,934

[22] Filed: Dec. 21, 1982

[30] Foreign Application Priority Data

Dec. 21, 1981 [DE] Fed. Rep. of Germany ..... 3150663

[51] Int. Cl.[4] ..... G21F 5/05

[52] U.S. Cl. ..... 250/506.1; 376/272

[58] Field of Search ..... 250/506.1; 252/633; 220/256; 376/272

[56] References Cited

U.S. PATENT DOCUMENTS

| | | | |
|---|---|---|---|
| 4,002,284 | 1/1977 | Suppus | 228/115 |
| 4,129,309 | 12/1978 | Köhnert et al. | 277/189.5 |
| 4,272,683 | 6/1981 | Baatz et al. | 250/506.1 |
| 4,278,892 | 7/1981 | Baatz et al. | 250/506.1 |
| 4,387,627 | 6/1983 | Avezou | 277/189.5 |
| 4,437,578 | 3/1984 | Bienek et al. | 220/256 |

FOREIGN PATENT DOCUMENTS 2942092 10/1979 Fed. Rep. of Germany ... 250/506.1

*Primary Examiner*—Alfred E. Smith
*Assistant Examiner*—Richard Hanig
*Attorney, Agent, or Firm*—Walter Ottesen

[57] ABSTRACT

The invention is directed to a container for the interim and long-term storage of radioactive material such as irradiated nuclear reactor fuel elements. The container includes a vessel and a cover. The vessel has a base and a wall extending upwardly from the base. The wall terminates in an upper end portion defining the opening of the vessel for receiving the radioactive material to be stored therein. A sealing cover tightly closes the vessel. The vessel is a double-walled body made up of two metal layers defining the outer and inner walls of the vessel. The inner wall constitutes a base structure made of an inexpensive and mechanically stable material; whereas, the outer wall is made of a corrosion-resistant material. In order to produce the outer wall at low cost and with a minimal technical effort, the inner wall is made of a material selected from the group including nodular cast iron and gray cast iron and the outer wall is made of high-alloy austenitic cast iron containing nodular graphite, the latter being cast around the base structure. The opening of the vessel is closed with a sealing cover welded to the outer wall of the vessel. Methods of making the vessel of the container are also disclosed.

6 Claims, 2 Drawing Figures

CONTAINER FOR THE INTERIM AND LONG-TERM STORAGE OF RADIOACTIVE MATERIAL

FIELD OF THE INVENTION

The invention relates to a double-walled container for the long-term storage of radioactive material such as irradiated nuclear reactor fuel elements. The container is also suitable for the interim storage of such material. Methods of making the double-walled vessel of the container are also disclosed.

BACKGROUND OF THE INVENTION

Containers for long-term storage have to be mechanically stable, resistant to corrosion and must be tightly closed. The vessel of the container is therefore made of steel or cast iron containing nodular graphite in order to ensure the mechanical stability of the container. It is preferable to utilize cast iron containing nodular graphite of a grade such as GGG-40 for making thick-walled container vessels because spheroidal cast iron exhibits especially high strength and toughness. The grade GGG-40 is listed in German nodular cast iron specifications.

The corrosion-resistance of steel or cast iron is inadequate for the purpose of long-term storage. Accordingly, it has been suggested to apply a corrosion-resistant protective outer layer to a container vessel made of steel or cast iron. This protective layer can be made of ceramic or graphite.

It has been suggested to produce the vessel of a container from a thick-walled layer of steel with an outer layer of zircaloy-2. The thin coating of corrosion-resistant zircaloy-2 is pulled over the inner base structure of the vessel and is shrunk thereon. Alternatively, the zircaloy-2 can be plated to the vessel base structure. The coating of the vessel base structure with zircaloy-2 is very expensive and requires a major engineering effort. Shrinking or plating the outer zircaloy layer onto the vessel base structure does not provide a failure-free bond between the two layers of the container. The zircaloy layer is relatively thin so that weld and material failures constitute serious disadvantages for the integrity of the sealing of the container with respect to the ambient.

SUMMARY OF THE INVENTION

It is an object of the invention to provide a container of the kind described above having an outer corrosion-resistant protective layer that is inexpensive and can be applied with a minimal technical effort. It is another object of the invention to provide a method for producing the vessel of the container.

The container of the invention is suitable for both the interim and long-term storage of radioactive material such as irradiated nuclear reactor fuel elements. The container includes a vessel having a base and a wall extending upwardly from the base. The wall terminates in an upper end portion defining the opening of the vessel through which the radioactive material to be stored therein is passed. According to a feature of the container, the vessel is a double-walled body having an inner wall made of a mechanically strong material selected from the group including nodular cast iron and gray cast iron and having an outer wall cast in surrounding relationship to the inner wall. The outer wall is made of a corrosion-resistant, high-alloy austenitic castable material containing nodular graphite. A cover is weldable to the outer wall at the upper end portion for closing the opening and sealing the container with respect to the ambient.

As described above, the inner wall is made of nodular cast iron and can be viewed as being a base structure. This base structure is placed in a mold and molten high-allwy austenitic cast iron is poured so that it is cast in surrounding relationship to said base structure to form the outer wall of the vessel. The surface of the base structure is thereby caused to melt so that a good bond is formed between the base structure and the outer wall. The structure of the outer wall is similar to the structure of the nodular cast iron inner wall and this situation contributes to the good bond between the inner and outer walls of the vessel.

The method of making the vessel of the double-walled container can therefore include the steps of pouring molten austenitic cast iron containing nodular graphite into a vessel-shaped mold wherein the base structure constitutes the inner mold-piece of the mold, and maintaining the base structure at a temperature corresponding to the temperature of the molten austenitic cast iron during the pouring step whereby shrinkage of the outer wall with respect to the base structure is avoided and the formation of micro-fissures in the outer wall is prevented.

Another method of making the vessel of the double-walled container includes the steps of placing a sheet-steel partition wall between the inner and outer mold pieces of a mold defining the inner and outer surfaces, respectively, of the double-walled vessel, the sheet-steel partition wall and the inner mold piece conjointly defining a hollow inner space for receiving the material of which the inner wall is made and, the sheet-steel partition wall and the outer mold conjointly defining a hollow outer space adjacent the inner space for receiving the material of which the outer wall is made, and simultaneously pouring molten nodular cast iron and molten austenitic cast iron containing nodular graphite into said inner and outer hollow spaces, respectively. The sheet-steel partition wall is fused into the vessel and becomes part of the fusion joint joining the inner and outer walls to each other.

The outer layer or wall of high-alloy austenitic cast iron containing nodular graphite provides excellent resistance to heat and corrosion while at the same time having good workability and casting characteristics. The principle advantage of this material is that it is cold-weldable.

It is noted that a cold-weldable material is a material which can be welded without the necessity of conducting a follow-up heat treatment. In materials of this kind, no substantial tensions or structural changes occur during the welding operation which can lead to micro-fissures that must be corrected by an additional heat treatment operation subsequent to the welding operation.

After the vessel is filled with radioactive material, the sealing cover can be cold-welded to the vessel, the cover being made of a material having a structure similar to that of the outer wall of the vessel. A subsequent heat treatment of the container is unnecessary.

The outer wall cast in surrounding relationship to the inner wall can have a thickness that is substantially greater than that of the zircaloy casing plated on the vessel as suggested above. Because of the thickness that can be achieved and the good bond between the inner and outer walls, the container of the invention is useful not only for storage, but also for transporting irradiated fuel elements between the nuclear power plant and the location whereat these fuel elements are placed for long-term storage.

The invention affords the further advantage of providing a corrosion-resistant protective layer which protects the container against attacks of moisture from the outside. The container of the invention is robust and resistant to action from the outside such as shock, friction, shear forces as well as against fire. Further, the invention also enables the container to be manufactured with good reproducibility.

In a preferred embodiment, the material of the outer wall is austenitic nodular cast iron containing by weight a maximum of 3% carbon and 13 to 36% nickel as well as small alloy quantities of silicon, copper and chromium. Such a material is GGG NiCr 20.2 which is known commercially in Germany as "Ni-Resist".

BRIEF DESCRIPTION OF THE DRAWING

The invention will now be described with reference to the drawing wherein.

DESCRIPTION OF THE PREFERRED EMBODIMENTS OF THE INVENTION

Figure 1:
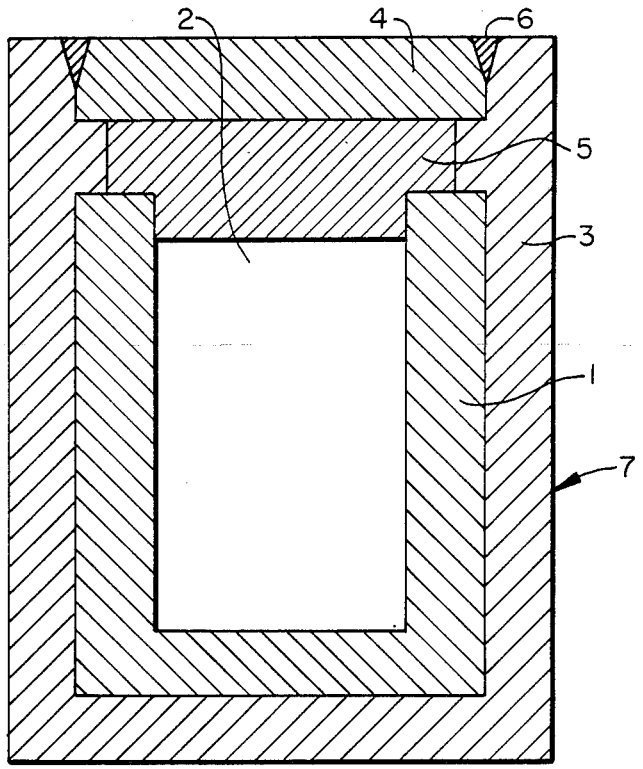
FIG. 1 is a side elevation view, in section, of a container according to the invention.

The container shown in FIG. 1 can be utilized to receive and store irradiated nuclear reactor fuel elements (not shown). The container has a thick-walled base structure 1 made of nodular cast iron. This base structure 1 is cylindrical and has an upper end portion defining opening 2 for loading the container with the fuel elements (not shown).

An outer wall layer 3 made of high-alloy austenitic nodular cast iron is cast in surrounding relationship to the base structure and defines the outer wall of the vessel.

The open end of the vessel 7 is closed off by a sealing cover 4 made of the same material as the vessel outer wall 3. The cover 4 is joined seal tight to the outer wall 3 of the vessel 7 by means of a weld 6. The weld 6 can be made of a nickel alloy having a structure similar to Ni-resist and can be laid down by the gas-shielded arc-welding process. A further cover 5 is arranged within the container and is joined to the base structure 1 with the aid of screws (not shown).

Since the sealing cover 4 is made of the same material as the outer wall 3 and is therefore also cold-weldable, a subsequent heat treatment of the container after the welding operation is unnecessary.

The base structure 1 serves as a mold piece of the casting mold and is placed therein during the process for making the outer wall 3 of the double-walled vessel 7. After the high-alloy austenitic nodular cast iron is poured into the mold, the outer surface of the inner wall or base structure 3 becomes fused to the outer wall because of melting of the outer surface of the base structure. The two layers or walls 1 and 3 of the vessel are thereby tightly joined with each other.

When pouring the austenitic nodular cast iron, it is desirable to maintain the temperature of the base structure at a temperature corresponding substantially to that of the molten austenitic nodular cast iron thereby preventing shrinkage of the outer wall with respect to the base structure 1 defining the inner wall. For example, the inside base structure can be maintained at a temperature of 800° C.

A further method of making the vessel of the double-walled container involves centrifugal casting. According to this method, the corrosion-resistant material of the outer wall comprising cold-weldable Ni-resist is first cast into a centrifugal mold. Thereafter, the base structure material comprising nodular cast iron (GGG-40) is cast into the mold.

Figure 2:
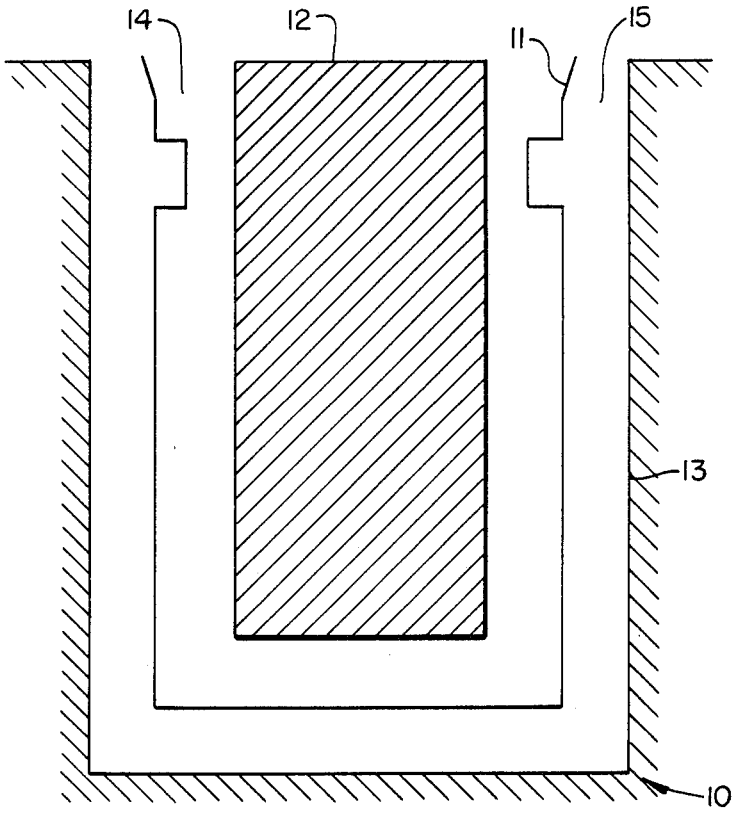
FIG. 2 is a schematic diagram showing a vessel mold having a partition wall made of sheet steel placed therein to facilitate making a vessel of the container acording to one method of the invention.

According to another method of the invention for making the vessel 7, a casting mold 10 of the kind shown schematically in FIG. 2 can be provided with a partition wall 11 made of sheet steel. The sheet steel 11 is placed between inner mold piece 12 and the outer mold piece 13. These mold pieces 12 and 13 define the inner and outer surfaces, respectively, of the double-walled vessel. The sheet-steel partition wall 11 and the inner mold piece 12 conjointly define a hollow inner space 14 for receiving the material of which the inner wall is made. Also, the sheet-steel partition wall and the outer mold conjointly define a hollow outer space 15 adjacent the inner space 14 for receiving the material of which the outer wall is made.

After the mold is prepared as described above, molten cast iron selected from the group including nodular cast iron and gray cast iron is poured into the hollow inner space 14 while at the same time, molten austenitic cast iron containing nodular graphite is poured into the hollow outer space 15. The two melts are poured simultaneously into the respective hollow inner and outer spaces 14 and 15. The sheet steel 11 melts and becomes part of the fusion joint joining the layers to each other.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

What is claimed is:

1. A container for the interim and long-term storage of radioactive material such as irradiated nuclear reactor fuel elements comprising:

a vessel having a base and a wall extending upwardly from said base, said wall terminating in an upper end portion defining the opening of the vessel through which the radioactive material to be stored therein is passed;

said vessel being a double-walled body having an inner wall made of a mechanically strong material selected from the group consisting of nodular cast iron and gray cast iron and having an outer wall cast in surrounding relationship to said inner wall thereby defining an interface therebetween, said outer wall being made of a corrosion-resistant, high-alloy austenitic castable material containing nodular graphite;

fusion bond means extending over all of said interface between said inner wall and said outer wall for tightly joining said walls to each other; and, a cover weldable to said outer wall at said upper end portion for closing said opening and sealing said container with respect to the ambient.

2. The container of claim 1 wherein said material of said outer wall is an austenitic nodular cast iron containing by weight a maximum of 3% carbon and 13 to 36% nickel as well as small alloy quantities of silicon, copper and chromium.

3. The container of claim 1, said cover being made of the same material as said outer wall.

4. A container for the interim and long-term storage of radioactive material such as irradiated nuclear fuel elements comprising:

a vessel having a base and a wall extending upwardly from said base, said wall terminating in an upper end portion defining the opening of said vessel through which the radioactive material to be stored therein is passed;

said vessel being a double-walled body having an inner wall made of a mechanically strong material selected from the group consisting of nodular cast iron and gray cast iron and having an outer wall cast in surrounding relationship to said inner wall thereby defining an interface therebetween, said outer wall being made of a corrosion-resistant, high-alloy austenitic castable material containing nodular graphite;

fusion bond means extending over all of said interface between said inner wall and said outer wall for tightly joining said walls to each other;

first cover means engaging said inner wall for closing said opening; and, second cover means cold-weldable to said outer wall for closing said container and sealing the latter with respect to the ambient.

5. The container of claim 4, said second cover means being made of the same material as said outer wall.

6. The container of claim 4 comprising: a weld made of cold-weldable material for joining said second cover means to said outer wall thereby tightly sealing said container with respect to the ambient.

* * * * *

UNITED STATES PATENT AND TRADEMARK OFFICE

CERTIFICATE OF CORRECTION

PATENT NO. : 4,572,959

DATED : February 25, 1986

INVENTOR(S) : Franz-Wolfgang Popp and Kurt Feuring

It is certified that error appears in the above-identified patent and that said Letters Patent is hereby corrected as shown below:

In column 2, line 8: delete "allwy" and substitute -- alloy -- therefor.

In column 4, line 65: delete "container with respect to the ambient." and substitute the following therefor:

-- container with respect to the ambient;

said outer wall of said vessel and said cover both being a cold-weldable material so as to permit closing said container from the ambient with a weld free of unwanted microfissures and formed without the necessity of conducting a follow-up heat treatment to remove such unwanted microfissures. --

UNITED STATES PATENT AND TRADEMARK OFFICE

CERTIFICATE OF CORRECTION

PATENT NO. : 4,572,959

DATED : February 25, 1986

INVENTOR(S) : Franz-Wolfgang Popp and Kurt Feuring

It is certified that error appears in the above-identified patent and that said Letters Patent is hereby corrected as shown below:

In column 6, line 11: delete "with respect to the ambient." and substitute the following therefor:

-- with respect to the ambient with a weld free of unwanted microfissures and formed without the necessity of conducting a follow-up heat treatment to remove such unwanted microfissures. --

Signed and Sealed this

*Fifth* Day of *August 1986*

[SEAL]

*Attest:*

DONALD J. QUIGG

*Attesting Officer*

*Commissioner of Patents and Trademarks*